US006835286B2

(12) United States Patent
Honkalampi et al.

(10) Patent No.: US 6,835,286 B2
(45) Date of Patent: Dec. 28, 2004

(54) PRESS ROLL BELT AND A PRESS CONCEPT

(75) Inventors: Petter Honkalampi, Kinkomaa (FI); Heikki Kaasalainen, Jyväskylä (FI); Nils Söderholm, Anjalankoski (FI)

(73) Assignee: Metso Paper, Inc., Helsinki (FI)

( * ) Notice: Subject to any disclaimer, the term of this patent is extended or adjusted under 35 U.S.C. 154(b) by 234 days.

(21) Appl. No.: 10/117,459

(22) Filed: Apr. 5, 2002

(65) Prior Publication Data

US 2002/0153116 A1 Oct. 24, 2002

(30) Foreign Application Priority Data

Apr. 6, 2001 (FI) ..... 20010721

(51) Int. Cl.[7] ..... D21F 3/04

(52) U.S. Cl. ..... 162/358.4; 162/358.1; 162/358.3; 162/901; 428/167; 428/169; 100/118; 100/121

(58) Field of Search ..... 162/358.1, 358.2, 162/358.3, 358.4, 306, 348, 900–904, 206; 492/28–37, 20; 428/156, 163, 167–173; 100/110–129; 198/844.1, 845–847

(56) References Cited

U.S. PATENT DOCUMENTS 4,366,025 A * 12/1982 Gordon et al. ..... 162/358.1
4,880,501 A 11/1989 Schiel
4,944,820 A 7/1990 McCarten
5,445,588 A * 8/1995 Ishibashi et al. ..... 492/31
6,428,874 B1 * 8/2002 McGahern et al. ..... 428/167

FOREIGN PATENT DOCUMENTS

| | | | | |
|---|---|---|---|---|
| DE | 689 04 673 T2 | | 5/1993 | |
| DE | 196 31 404 A1 | | 2/1998 | |
| DE | 196 31 405 A1 | | 2/1998 | |
| EP | 0 866 044 A1 | * | 12/1998 | ..... D21F/3/02 |
| EP | 0 889 164 A1 | | 7/1999 | |
| FI | 881243 | | 12/1990 | |
| FI | 85607 | | 1/1992 | |
| JP | 08-013373 | * | 1/1996 | ..... D21F/3/00 |

* cited by examiner

*Primary Examiner*—Peter Chin
*Assistant Examiner*—Eric Hug
(74) *Attorney, Agent, or Firm*—Stiennon & Stiennon

(57) ABSTRACT

A press roll belt is arranged to be used in connection with a roll (10) forming a press nip. The belt (12) of the press roll (10) is provided with a groove pattern formed of intersecting grooves (11A, 11B). A press concept has at least one press nip formed between two rolls (30, 32) to remove water from a web. At least one press nip (NA) of the press concept is formed such that the cover (22) or the belt (12) of at least one roll (30A, 32A) forming the press nip is provided with groove patterning formed of intersecting grooves (11A, 11B; 21A, 21B).

20 Claims, 5 Drawing Sheets

PRESS ROLL BELT AND A PRESS CONCEPT

CROSS REFERENCES TO RELATED APPLICATIONS

This application claims priority on Finnish Application No. 20010721, filed Apr. 6, 2001, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to the manufacture of paper, board and pulp and in particular, and to presses of their wire, pre-press and press sections. In certain application, an abundance of open water space is needed in connection with a press nip in the press section in order that the water removed from a web during pressing may be passed out of connection with the web and the press nip.

In the prior art, roll covers are known in which various groove patterns are used. With respect to the prior art relating to these, reference may be made to laid-open publications DE 196 31 404 and DE 196 31 405. These publications describe some arrangements with a roll cover provided with groove patterning.

In the prior art, press roll belts are also known in which the belts are made of crosswise woven threads, but they do not provide a large open water volume because the surface that is formed is smooth. One such arrangement is disclosed in EP publication 0 889 164.

With respect to the prior art, reference is also made to EP patent 0 336 876 disclosing an extended-nip press belt which is provided with grooves extending in the running direction of the web.

As known in the prior art, a press concept comprises at least one press nip formed between two rolls, one of which can be, for example, a shoe press roll. The web runs through the press nip while supported by a fabric, and water is removed from the web by pressing in the press nip. In paper, board and pulp machines there are press nips in the press section as well as in the wire section and the pre-press section as press units. In one prior art application, the press concept of the wire section comprises a roll press and a shoe press in which the same press felt and the same wet wire are passed through both nips.

As known in the prior art, in some applications, the belt of a shoe press roll can be provided with a water volume of about 250–500 g/m$^2$ by means of grooves and with a water volume of up to about 600 g/m$^2$ by means of grooves and blind-drilled bores. One problem with these prior-art grooved belts is that, when the belt becomes older, the raised portions between the grooves break and, based on experience, a narrower and higher raised portion, i.e. the portion between the grooves, breaks more easily than a lower and broader portion. The belt can also be manufactured so that it is grooved and blind-drilled bored, which is somewhat more durable than a merely grooved belt, but this option is not applicable when high water handling capacity is needed because, during the pressing process, less water is guided into a blind-drilled surface than into a grooved one, even though the water volume would be the same, because no flow of water is produced in the holes of a blind-drilled surface, unlike the grooves of a grooved surface where a flow of water is produced.

SUMMARY OF THE INVENTION

An object of the invention is to provide a press roll belt which has a large water volume and thus also high water handling capacity. In addition, its durability is superior to that of prior-art designs.

A further object of the invention is also to provide a press roll belt which has high water handling capacity and which does not mark the surface of the web.

An object of the invention is also to provide press concepts in which water handling capacity is high.

In accordance with the invention, a groove pattern is used in a press roll belt either in a belt in connection with a roll or in a separate belt arranged in connection with a roll, which groove pattern is formed of intersecting grooves producing a quadrangle pattern, for example, a rhombus pattern, a rectangle pattern, a parallelogram pattern, a square pattern, a diamond pattern. The water volume of the belt is increased by this kind of groove pattern, however, without losing surface strength properties. The angle between the intersecting grooves in the direction of rotation of the roll is 40–140°, preferably 70–100°. When better durability is needed, a smaller angle is selected, preferably about 70°. In accordance with an advantageous feature of the invention, two groove patterns are formed of intersecting grooves, one of the patterns being placed between the grooves of the other pattern, which groove patterns have different groove depths.

In this description, the term "press roll belt" means both a belt arranged in connection with a roll, i.e. a belt forming an integral part of the roll, and a separate belt arranged in connection with a roll, which belt has its own belt loop and rolls associated therewith, unless it clearly appears otherwise from the context.

In accordance with the invention, a surface pattern having a large water volume is achieved by this means, said pattern having a durable structure and allowing the open surface area/water volume to be changed in a wider area than allowed by the machine-direction grooves used in prior-art applications. The groove pattern in accordance with the invention is also simple to manufacture.

By means of the patterning in accordance with the invention, for example, the following values are achieved with different width and depth values of the groove: groove width may be, for example, 0.5–1.5 mm and groove depth 0.5–1.0 mm, the open surface area 25–60%, in which case the water volume is, for example, with groove depth 1.0 mm, groove width 1 mm, open surface area 31%, piece size 5×5 mm→water volume of 305 g/m$^2$; with groove depth 1.0 mm, groove width 1 mm, open surface area 49%, piece size 2.5×2.5 mm→water volume of 490 g/m$^2$; with groove depth 1.5 mm, groove width 1.5 mm, open surface area 61%, piece size 2.5×2.5 mm→water volume of 914 g/m$^2$, and with groove depth 1.6 mm→water volume of 1000 g/m$^2$.

In the press concept in accordance with the invention, at least one press nip is formed such that at least one roll forming a press nip with another roll has a cover or a roll belt or a separate belt used in connection with the roll which is provided with groove patterning, quadrangle patterning, formed of intersecting grooves, whereby the water volume can be increased in the press nip. The press concept in accordance with the invention is suitable for use in the manufacture of paper, board and pulp in connection with press nips of a wire section, pre-presses and a press section.

In accordance with an advantageous embodiment example of the invention, when two groove patterns of different depth are used in the quadrangle patterning, the "partial pieces" defined by the grooves do not come off, which improves the durability of the belt used in the press concept, in particular when water volume is large. Thereby is also provided a larger water volume and a more durable structure as compared with grooves of equal depth.

In the press concepts in accordance with the invention, a belt provided with a groove pattern is advantageously used in connection with an extended nip roll, in particular on a roll on the wire side and in press roll belts.

One application in accordance with the invention is an extended nip press in which one of the rolls has a groove pattern in accordance with the invention either in a separate belt arranged in connection with a lower roll or in the belt or cover of a counter roll.

The invention is applied in web dewatering presses, in particular in connection with the manufacture of paper, board and pulp webs.

The press concept in accordance with the invention can be applied, for example, in presses of a wire section in a pulp machine, in which connection the water quantities to be removed are as follows: a roll press about 500–700 g/m$^2$ and a shoe press about 1000–1300 g/m$^2$. These large water quantities to be removed also require a large water space in the surface of counter rolls, and large water volumes are achieved by the concepts in accordance with the invention. A large water volume is provided by means of intersecting grooves, for example, by grooves which intersect at an angle of 90° and which provide a quadrangle pattern. The press must handle large water quantities also when the solids entering the nip are low, for example, 10–14% with a basis weight of 80 g/m$^2$ or 10% with a basis weight of 40 g/m$^2$.

BRIEF DESCRIPTION OF THE DRAWINGS

In the following, the invention will be described in greater detail with reference to the figures in the appended drawing, in which.

DESCRIPTION OF THE PREFERRED EMBODIMENTS

Figure 1A:
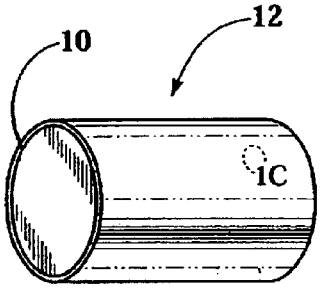
FIG. 1A is a schematic view of a shoe press roll belt in accordance with one embodiment of the invention.
Figure 1C:
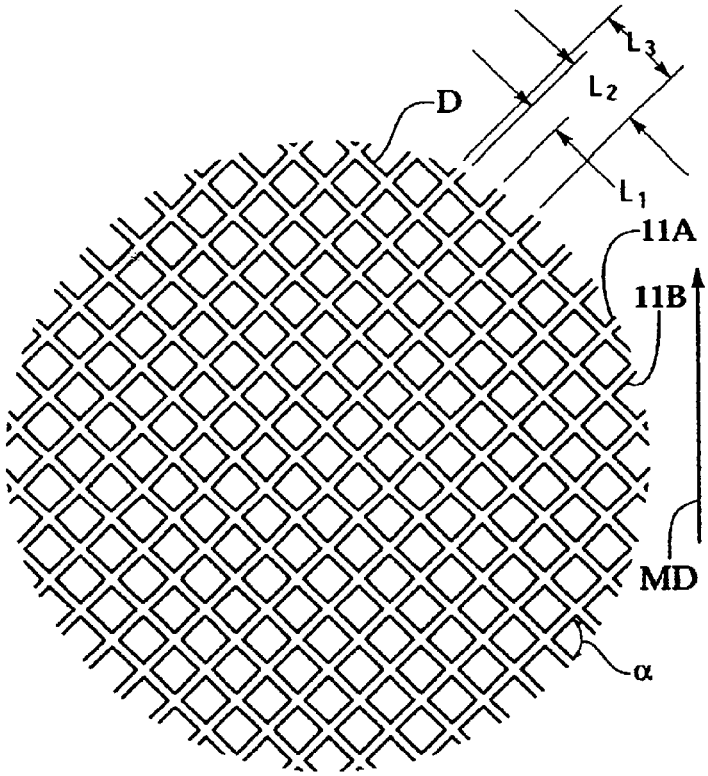
FIG. 1C is an enlarged view of a fragmentary section of the surface pattern of the belt of FIG. 1A taken at the segment 1C—1C.

FIG. 1A shows a partial enlargement of the surface of a belt 12 on a shoe press roll 10, which surface is provided with a surface patterning in accordance with the invention, said surface patterning being formed of intersecting grooves 11A, 11B forming a quadrangle pattern. The depth D of the groove is 1–5 mm, preferably 1.6 mm and the width L of the groove is 0.7–2.5 mm, preferably 1.6 mm, and the groove measurements are, for example, L1=2.5 mm, L2=6.6 mm and L3=8.2 mm. The grooves according to this example provide an open surface area of 63% and a water volume (Water Volume) of 1000 g/m$^2$. The machine direction is denoted with the arrow MD in the figure. The angle $\alpha$ between the grooves 11A, 11B in the direction of rotation of the roll, i.e. in the machine direction, is 40–140°, preferably 70–100°.

Figure 1B:
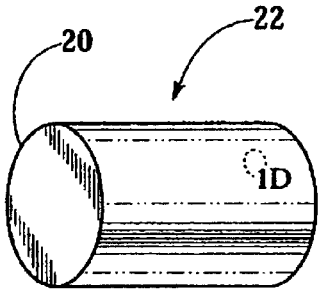
FIG. 1B is a schematic view of a surface pattern of a roll surface used in connection with a press concept in accordance with the invention.
Figure 1D:
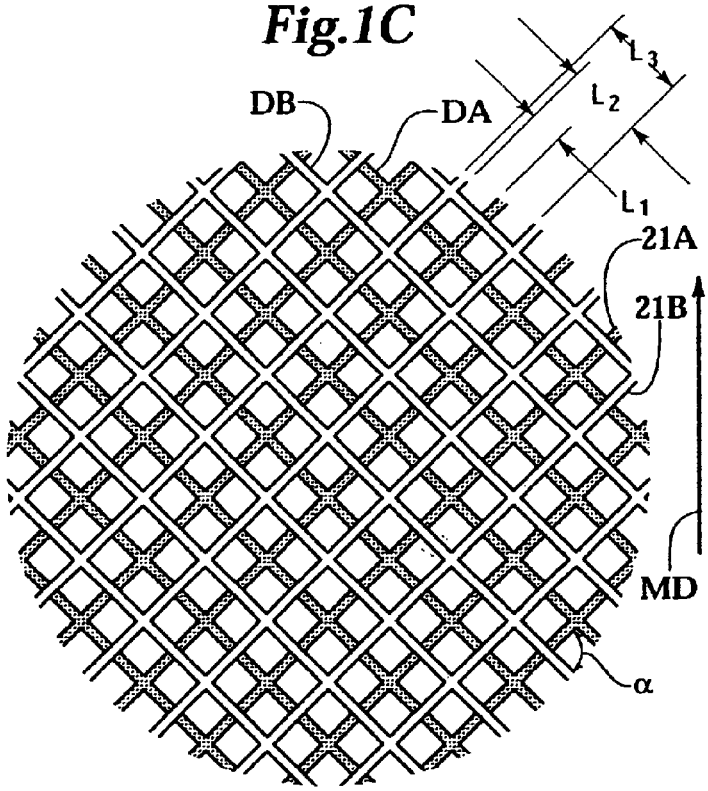
FIG. 1D is an enlarged view of a fragmentary section of the surface pattern of the belt of FIG. 1B taken at the segment 1D—1D.

A surface pattern of a surface 22 of a roll 20 used in connection with a press concept in accordance with the invention is shown in FIG. 1B. The surface pattern is formed of two groove patterns 21A, 21B laid crosswise a nd having different depths DA, DB. The depth of the first groove patterning DA is 1–2 mm, preferably 1.6 mm, and the depth of the second one DB is 1–5 mm, preferably 4.5 mm. The measurements L1–L3 correspond to the measurements shown in FIG. 1A. This groove patterning provides an open surface area of 63% and a water volume of 2000 g/m$^2$. The machine direction is denoted with the arrow MD in the figure. The angle $\alpha$ between the crossing grooves of the groove pattern 21A, 21B in the direction of rotation of the roll, i.e. in the machine direction, is 40–140°, preferably 70–100°.

The groove patterning of the belt shown in FIG. 1A can, of course, be formed as shown in FIG. 1B, and vice versa.

Figure 2A:
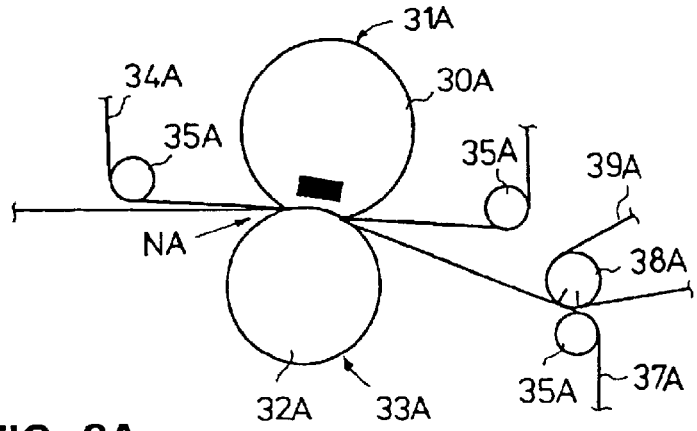
FIGS. 2A–2C are schematic views of alternative embodiments of the press concept in accordance with this invention.
Figure 2B:
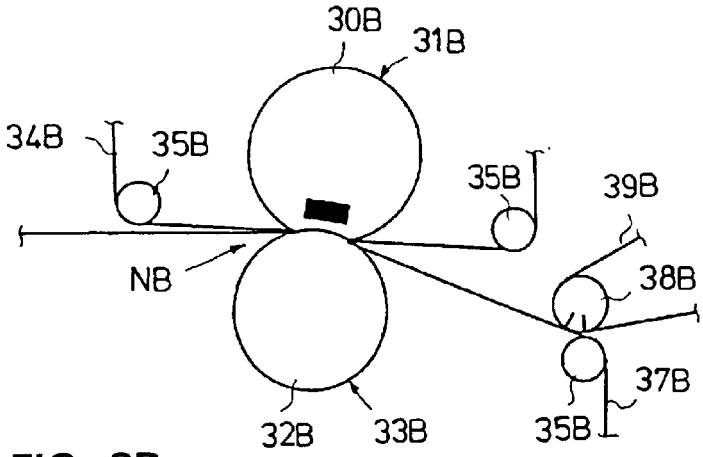
Figure 2C:
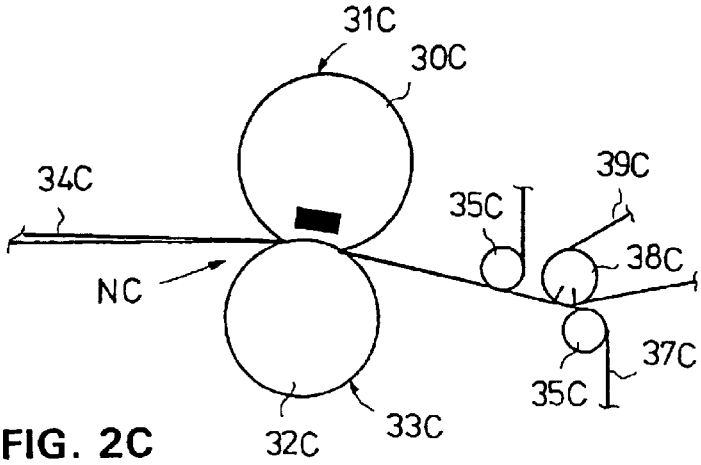

FIGS. 2A–2C show embodiments of the press concept in accordance with the invention, comprising one press nip. In the discussion of the embodiments 2A–2C, parts in the different embodiments will be referred to by similar numeric designations followed by either the letter A, B, or C, corresponding to FIGS. 2A, 2B, or 2C respectively. An upper fabric, for example, a press felt running through a nip N is denoted with the reference numeral 34, a lower fabric, for example, a wire, with the reference numeral 37 and rolls forming a press with the reference numerals 30 and 32, a roll belt with the reference numeral 31 and a roll cover with the reference numeral 32. In the figures, wire and felt guide rolls are denoted with the reference numeral 35 and a transfer suction roll, by which a web is transferred to the next treatment stage, with the reference numeral 38 and the wire of the next treatment stage is denoted with the reference numeral 39. The letters after the numbers refer to the part figure in question.

In FIG. 2A, the felt 34A and the wire 37A run through the nip NA between the rolls 30A, 32A and in this embodiment, the upper roll 30A is an extended-nip press roll provided with a belt 31A having a groove patterning in accordance with the invention. The lower roll 32A is provided with a groove patterning, for example, like the one shown in FIG. 1B, said groove patterning being formed in the cover 33A.

FIG. 2B shows an embodiment of the invention that differs from the embodiment shown in FIG. 2A in that the lower roll 32B is provided with a perforated shell 33B, i.e. its openness is provided by other means.

In the embodiment shown in FIG. 2C, two wires 34C, 37C run through the press nip NC. The upper roll 30C is an extended-nip press roll comprising a belt 31C provided with a groove pattern in accordance with the invention, and the roll surface 33C of the lower roll 32C is provided with a groove pattern, for example, like the one shown in FIG. 1B.

Figure 3A:
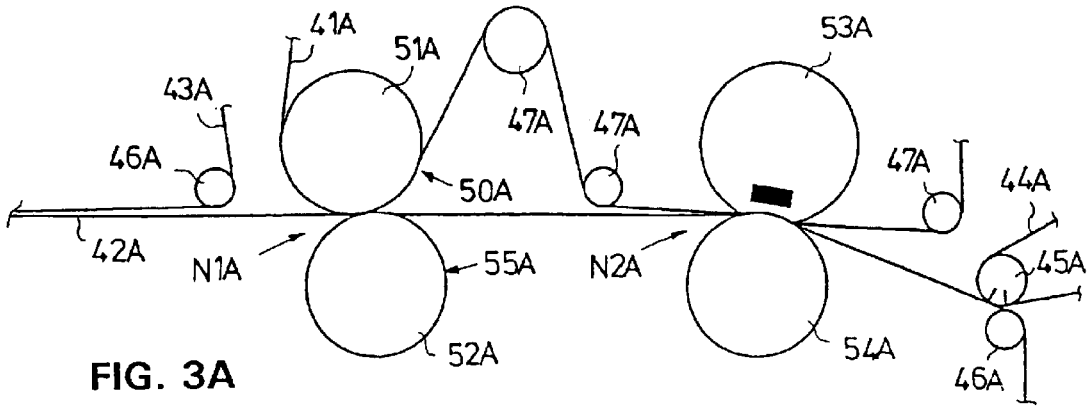
FIGS. 3A–3C are schematic views of some further embodiments of the press concept in accordance with this invention.
Figure 3B:
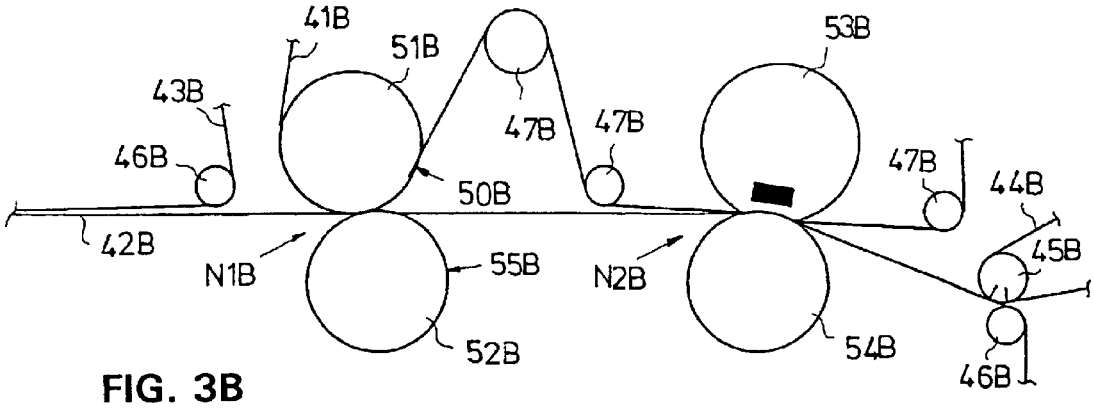
Figure 3C:
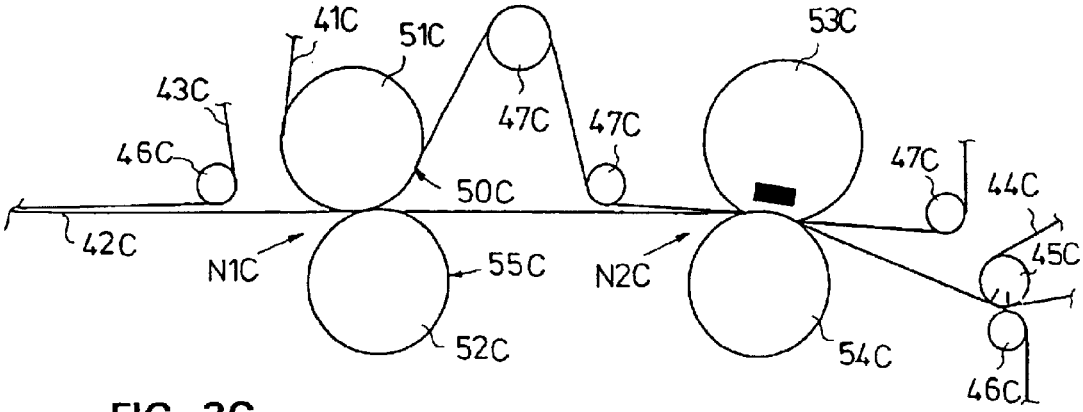

FIGS. 3A–3C show embodiments of the invention comprising two press nips N1, N2 and, in a manner corresponding to the preceding embodiment, the part figures are denoted with letter signs A–C. In FIGS. 3A–3C, a press felt 41 runs through both nips N1, N2 as the upper fabric of the press nips N1, N2 and the lower fabric is formed by a wire 42 which is passed through both nips N1, N2. The wire of the preceding treatment stage is denoted with the reference numeral 43 and the fabric of the next treatment stage is denoted with the reference numeral 44, onto which the web is passed on a transfer suction roll 45. The wire guide rolls are denoted with the reference numeral 46 and the alignment and guide rolls of the press felt are denoted with the reference numeral 47.

In FIG. 3A, the groove pattern shown in FIG. 1A or 1B is preferably arranged in connection with all rolls 51A, 52A, 53A, 54A at the press nips N1A, N2A and, in the embodiment shown in the figure, the first nip N1A is a roll nip and defined by two rolls 51A, 52A provided with, for example, the groove pattern cover 50A, 55A shown in FIG. 1B, but, when desired, it can be formed as a shoe press nip, in which case the belt of the shoe press roll is provided with a groove pattern in accordance with the invention. In the latter nip N2 there is an extended-nip press in which the cover 55A of the lower roll 54A is provided with a groove pattern, for example, like the one shown in FIG. 1B and the belt 56A of the upper roll 53A, which is an extended-nip roll, for example, a shoe press roll, is provided with a groove pattern in accordance with the invention.

The embodiment shown in FIG. 3B differs from the one shown in FIG. 3A in that the lower rolls 52*b*, 54B of the press nips N1B, N2B are perforated-shell rolls which have a so-called "through-drilled shell", i.e. a suction roll shell surface.

The embodiment shown in FIG. 3C differs from the preceding one in that only the lower rolls 52C, 54C of the press nips N1C, N2C are provided with groove patterning, for example, like the one shown in FIG. 1B.

Figure 4A:
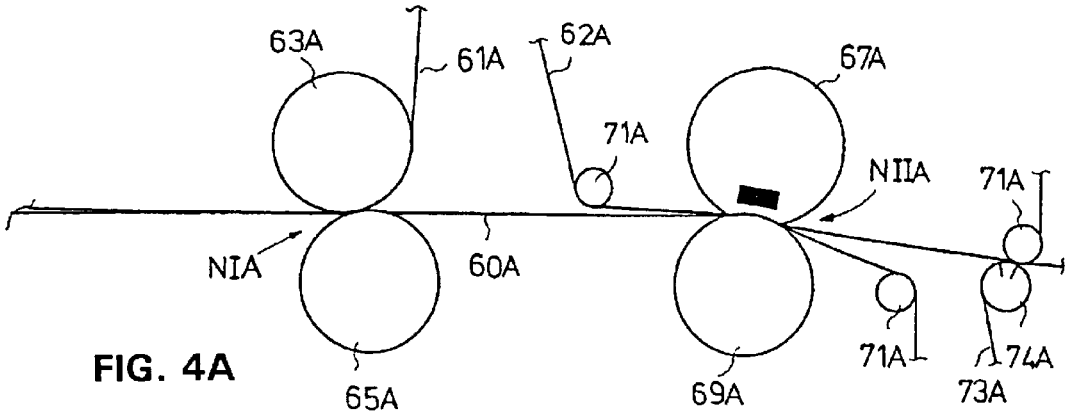
FIGS. 4A–4C are schematic views of some further embodiments of the press concept in accordance with with invention.
Figure 4B:
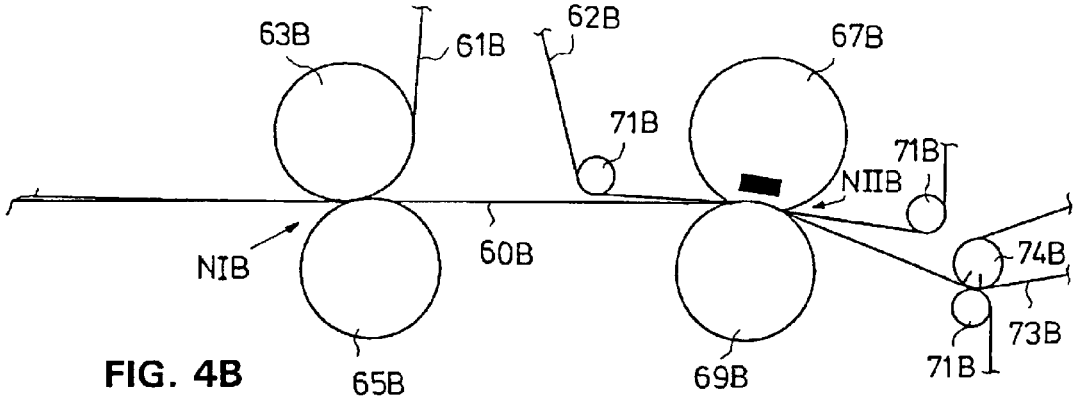
Figure 4C:
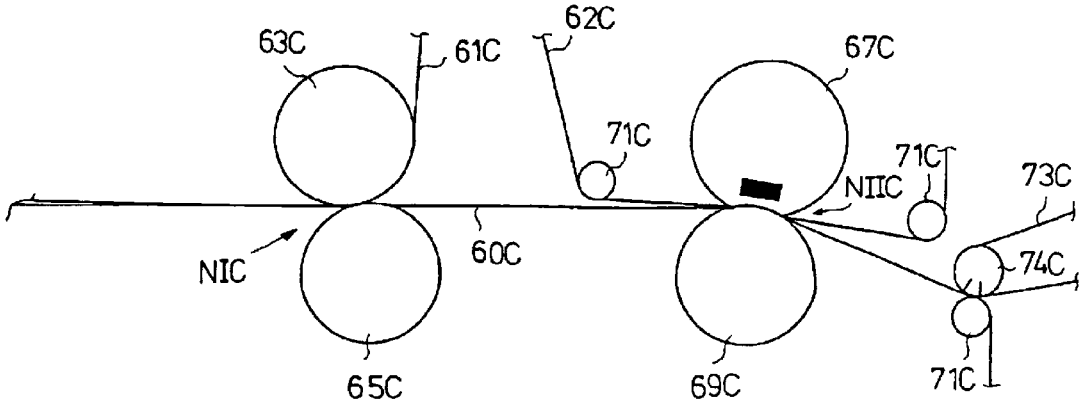

The embodiments shown in FIGS. 4A–4C differ from the embodiments shown in FIGS. 3A–3C primarily in that there is no common felt 41 running as the upper fabric in the press nips NI, NII. In FIG. 4A, a wire 61A runs through the first press nip NIA and a transfer belt 62A runs through the second nip NIIA as upper fabrics. In FIG. 4B, a wire 61B runs through the first nip NIB and a felt 62B runs through the second nip NIIB, and a wire 61C and a felt 62C run correspondingly in FIG. 4C. As the lower fabric 60A, 60B, 60C there is a wire. The alignment and guide rolls of the fabrics are denoted with the reference numeral 71 provided with a letter referring to a part figure. The fabric of the next treatment stage is denoted with the reference numeral 73 and the transfer suction roll with the reference numeral 74.

In FIGS. 4A–4C, rolls 63A, 65A; 63B, 65B; 63C, 65C in the first nip NIA, NIB, NIC are provided with a groove pattern, for example, like the one shown in FIG. 1A or 1B, forming a roll nip or a shoe press nip, and the latter nip NIIA, NIIB, NIIC is an extended nip, in which the belt 68B, 68C of the upper roll 67B, 67C of the nip NIIB, NIIC in FIGS. 4B and 4C is provided with a groove pattern in accordance with the invention and, in FIGS. 4A and 4C, the lower rolls 65A, 69A, 65B, 69B of the nips NI, NII are provided with a groove pattern cover, for example, like the one shown in FIG. 1A and, in FIG. 4C, the lower rolls 65C, 69C of both press nips NI, NII are rolls with a perforated shell.

Figure 5A:
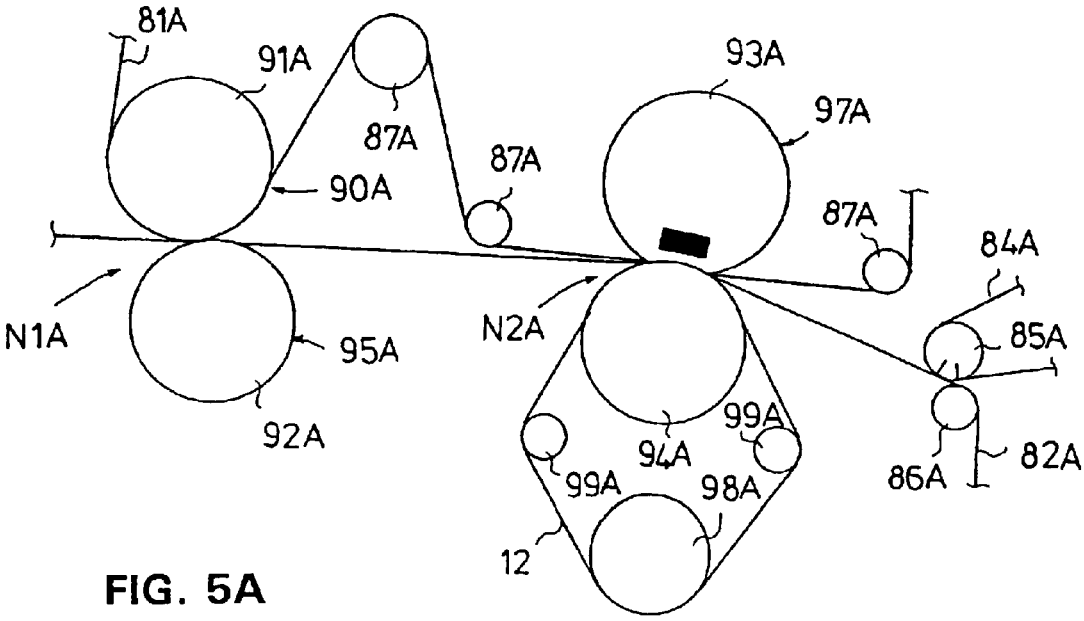
FIGS. 5A–5B are schematic views of some yet further embodiments of the press concept in accordance with this invention.
Figure 5B:
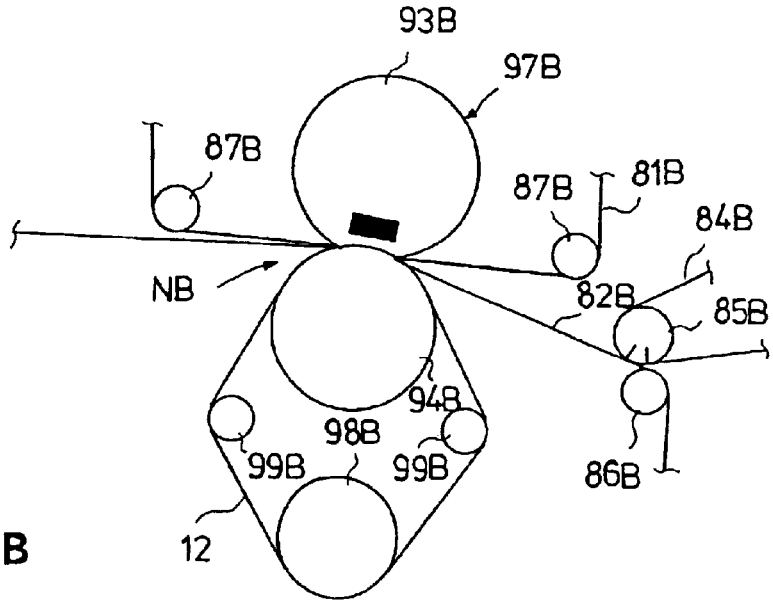

FIGS. 5A and 5B schematically show some embodiments of the invention for press section concepts in which, in connection with a press nip, a separate belt 12 provided with a groove pattern is arranged in connection with press nips N2A and NB in connection with a press roll.

The press concept shown in FIG. 5A comprises two press nips N1A, N2A, of which the first press nip N IA is formed between two press rolls 91A, 92A provided with a groove pattern cover 90A and the second press nip N2A is formed between an extended-nip press roll 93A provided with a groove pattern cover 97A and a press roll 94A in connection with which a separate belt 12 provided with a groove patterning is arranged. An upper felt 81A runs guided by guide and alignment rolls 87A, and a lower wire is denoted with the reference numeral 82A. Its run is guided by alignment and/or guide rolls 86A. Alignment and guide rolls 99A, 98A are arranged to guide the separate groove pattern belt of the press. The web is passed from the wire 82A on a transfer suction roll 85A onto support of a fabric 84A.

In the press concept shown in FIG. 5B there is one press nip NP which is formed between an extended-nip press roll 93B provided with a groove pattern cover 97B and its counter roll 94B. A separate groove pattern belt is arranged in connection with the counter roll 94B and it runs guided by guide and alignment rolls 99B and 98B. The upper fabric is denoted with the reference numeral 811B and it runs guided by guide and alignment rolls 87B, and the lower fabric is denoted with the reference numeral 82B and it runs guided by guide and alignment rolls 86B. The web is passed from the lower fabric over a transfer roll 85B so as to be guided by a fabric 84B.

The water volume in the press concepts shown in FIGS. 5A and 5B is produced by the groove patterning made to the surface of the separate belt 12. The belt 12 is not pervious to water and the water volume is provided in groove patterns, for example, like the ones shown in FIGS. 1A and 1B.

Above, the invention has been described with reference to some of its advantageous embodiment examples only, but the invention is by no means meant to be strictly confined to the details of said examples.

We claim:

1. A press roll belt which is arranged to be used in connection with a roll firming a press nip, wherein the belt of the press roll is provided with a first groove pattern formed of first intersecting grooves of a first depth, and a second groove pattern formed of second intersecting grooves of a second depth which is less than the first depth wherein the belt provided with a groove pattern is arranged in connection with a press roll as a separate belt.

2. The press roll belt of claim 1, wherein the first groove pattern is a quadrangle pattern.

3. The press roll belt of claim 1, wherein the first groove pattern is comprised of a first array of parallel grooves which intersect a second array of parallel grooves at an angle in the machine direction of 40–140°.

4. A press concept which comprises at least one press nip formed between two rolls to remove water from a web, wherein at least one press nip of the press concept is formed such that a belt of at least one roll forming the at least one press nip is provided with a first groove patterning formed of first intersecting grooves of a first depth, and a second groove patterning formed of second intersecting grooves of a second depth which is less than the first depth wherein the belt is used in connection with an extended-nip roll or a shoe press roll.

5. The press concept of claim 4, wherein the first groove patterning is a quadrangle patterning.

6. The press roll belt of claim 4 wherein the first groove pattern is comprised of a first array of parallel grooves which intersect a second array of parallel grooves at an angle in the machine direction of 40–140°.

7. A press concept which comprises at least one press nip formed between two rolls to remove water from a web, wherein at least one press nip of the press concept is formed such that a belt of at least one intersecting grooves of a first depth, and a second formed of second intersecting groves of a second depth which is less than the first depth, wherein the belt provided with a groove patterning is disposed in connection with a roll that is on a wire side.

8. The press roll belt of claim 7 wherein the first groove pattern is a quadrangle pattern.

9. The press roll belt of claim 7 wherein the first groove pattern is comprised of a first array of parallel grooves which intersect a second array of parallel grooves at an angle in the machine direction of 40–140°.

10. A press concept which comprises at least one press nip formed between two rolls to remove water from a web, wherein at least one press nip of the press concept is formed such that a belt of at least one roll forming the at least one press nip is provided with a first groove patterning formed of first intersecting grooves of a first depth, and a second groove patterning formed of second intersecting grooves of a second depth which is less than the first depth, wherein the belt provided with a groove patterning is arranged in connection with a press roll as a separate belt.

11. The press concept of claim 10, wherein the press concept is arranged to be used in connection with the manufacture of paper, board and/or pulp webs.

12. The press roll belt of claim 10 wherein the first groove pattern is a quadrangle pattern.

13. The press roll belt of claim 10 wherein the first groove pattern is comprised of a first array of parallel grooves which intersect a second array of parallel grooves at an angle in the machine direction of 40–140°.

14. A press concept which comprises at least one press nip formed between two rolls to remove water from a web, wherein the at least one press nip is provided with a first groove patterning formed of first intersecting grooves of a first depth, and a second groove patterning formed of second intersecting grooves of a second depth which is less than the first depth, wherein the press concept is arranged to be used in connection with a press of a wire section and/or a press nip of a press section.

15. The press concept of claim 14, wherein the groove patterning is a quadrangle patterning.

16. The press concept of claim 14, wherein the press concept is arranged to be used in connection with the manufacture of paper, board and/or pulp webs.

17. The press concept of claim 14 wherein the belt first groove pattern is comprised of a first array of parallel grooves which intersect a second array of parallel grooves at an angle in the machine direction of 40–140°.

18. A press concept which comprises at least one press nip formed between two rolls to remove water from a web, wherein at least one press nip of the press concept is formed such that a cover of at least one intersecting grooves of a first depth and a second groove patterning formed of second intersecting grooves of a second depth which is less than the first depth, wherein the press concept is arranged to be used in connection with a press of a wire section and/or a press nip of a press section.

19. The press concept of claim 18 wherein the cover first groove pattern is a quadrangle pattern.

20. The press concept of claim 18 wherein the cover first groove pattern is comprised of a first may of parallel grooves which intersect a second array of parallel grooves at an angle in the machine direction of 40–140°.

* * * * *

UNITED STATES PATENT AND TRADEMARK OFFICE

CERTIFICATE OF CORRECTION

PATENT NO. : 6,835,286 B2
DATED : December 28, 2004
INVENTOR(S) : Petter Honkalampi et al.

It is certified that error appears in the above-identified patent and that said Letters Patent is hereby corrected as shown below:

Column 3,
Line 34, “10%” should be -- 6-10% --

Column 6,
Line 21, “811B” should be -- 81B --
Line 39, “firming” should be -- forming --
Line 43, “depth” should be -- depth, --
Line 59, “depth wherein” should be -- depth, wherein --

Column 7,
Lines 4-5, “intersecting grooves of a first depth, and a second formed of a second intersecting groves” should be -- roll forming the at least one press nip is provided with a first groove patterning formed of first intersecting grooves of a first depth, and a second groove patterning formed of second intersecting grooves --

Column 8,
Line 1, after “wherein” insert -- at least one press nip of the press concept is formed such that a belt of at least one roll forming --
Line 21, after “one” insert -- roll forming the at least one press nip is provided with a first groove patterning formed of first --
Line 22, “depth” should be -- depth, --
Line 30, “may” should be -- array --

Signed and Sealed this

Tenth Day of May, 2005

JON W. DUDAS
*Director of the United States Patent and Trademark Office*